US012601137B2

(12) United States Patent
Rainey

(10) Patent No.: US 12,601,137 B2
(45) Date of Patent: Apr. 14, 2026

(54) MECHANICALLY STABILIZED EARTH (MSE) RETAINING WALL USING GEOSYNTHETIC REINFORCEMENT BELT WITH CURVILINEAR EMBED APPARATUS IN WALL PANEL

(71) Applicant: Earth Wall Products, LLC, Smyrna, GA (US)

(72) Inventor: Thomas L. Rainey, Marietta, GA (US)

(73) Assignee: EARTH WALL PRODUCTS, LLC, Smyrna, GA (US)

( * ) Notice: Subject to any disclaimer, the term of this patent is extended or adjusted under 35 U.S.C. 154(b) by 43 days.

(21) Appl. No.: 18/782,486

(22) Filed: Jul. 24, 2024

(65) Prior Publication Data

US 2024/0426074 A1 Dec. 26, 2024

Related U.S. Application Data

(63) Continuation-in-part of application No. 29/890,697, filed on Apr. 26, 2023, now Pat. No. Des. 1,105,900.

(51) Int. Cl.
*E02D 29/02* (2006.01)

(52) U.S. Cl.
CPC ..... *E02D 29/0233* (2013.01)

(58) Field of Classification Search
CPC ..... E02D 29/0233; E02D 29/0241; E02D 29/0225
See application file for complete search history.

(56) References Cited

U.S. PATENT DOCUMENTS

| | | | | |
|---|---|---|---|---|
| 5,839,855 | A † | 11/1998 | Anderson | |
| 8,579,549 | B2 † | 11/2013 | Freitag | |
| 8,790,045 | B2 † | 7/2014 | Cariou | |
| 10,501,907 | B2 † | 12/2019 | Freitag | |
| 11,391,009 | B2 † | 7/2022 | Bennani Braouli | |
| 2006/0110221 | A1 * | 5/2006 | Freitag | E02D 29/0241 405/262 |

(Continued)

FOREIGN PATENT DOCUMENTS

| | | |
|---|---|---|
| KR | 20160133952 | † 11/2016 |
| WO | 2021020643 | † 2/2021 |

*Primary Examiner* — Amber R Anderson
*Assistant Examiner* — Stacy N Lawson
(74) *Attorney, Agent, or Firm* — Thomas | Horstemeyer, LLP

(57) ABSTRACT

A curvilinear embed apparatus is disclosed for enabling connection of a geosynthetic reinforcement belt to a concrete wall panel of a mechanically stabilized earth (MSE) retaining wall. The curvilinear embed apparatus has walls defining a channel that extends from a first aperture through a curved body to a second aperture. The channel and apertures have a continuous uniform rectangular cross section, thereby creating a curvilinear tube-like structure. The reinforcement belt is passed through the rectangular channel. The curved body implements the requisite anchoring effect while also enabling easy insertion and passage of the geosynthetic reinforcement belt through the curvilinear embed apparatus. The curved body is also designed to cause the rectangular cross section as well as any anchored reinforcement belt to be rotated by 180 degrees from the first aperture to the second aperture.

23 Claims, 8 Drawing Sheets

(56) References Cited

U.S. PATENT DOCUMENTS

| | | | | |
|---|---|---|---|---|
| 2011/0236141 | A1* | 9/2011 | Freitag | E02D 29/0241 405/302.4 |
| 2013/0008098 | A1* | 1/2013 | Freitag | E02D 29/0225 52/741.11 |
| 2013/0022403 | A1* | 1/2013 | Freitag | E02D 29/0241 405/107 |
| 2013/0022411 | A1* | 1/2013 | Cariou | E02D 29/025 405/284 |
| 2018/0044878 | A1* | 2/2018 | Lee | E02D 17/20 |
| 2022/0220692 | A1* | 7/2022 | Rainey | E02D 29/0233 |

* cited by examiner
† cited by third party

EARTH WALL PRODUCTS
CONNECTION STRENGTH TESTING (ASTM D 6638 MODIFIED)

TEST SERIES NO. 3: Optima 45KN reinforcement belt connected to 18" L x 18" W x 5.5" thick precast retaining wall panel by cast the belt in the panel and pulling two ends of the belt together

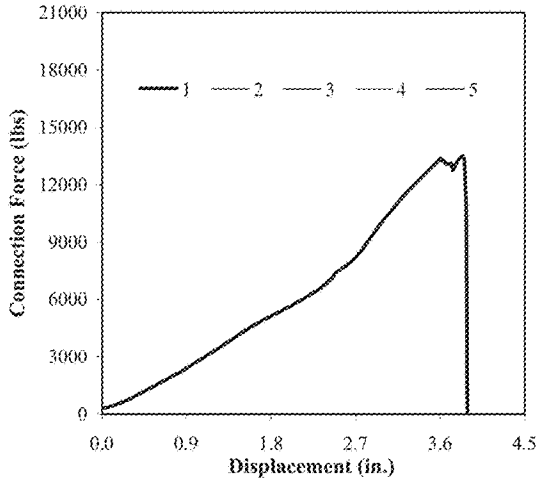

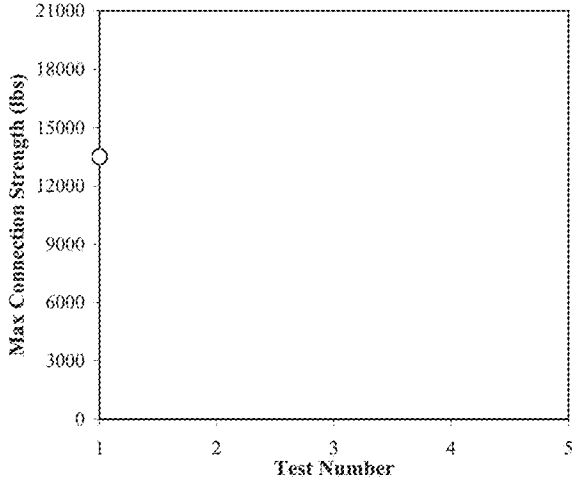

| Test No. | Reinforcement Belt Width (inch) | Panel Size | Connection Rebar Diameter (inch) | Connection Rebar Span (inch) | Normal Stress (psf) | Strength at Select Displacements Measured at the Front Clamp 0.2-in. (lbs) | 0.5-in. (lbs) | 0.75-in. (lbs) | Max Connection Force $F_{max}$ (lbs) | Displacement at Max Force (inch) | Failure Mode |
|---|---|---|---|---|---|---|---|---|---|---|---|
| 1 | 2.0 | 18.0" L x 18.0" H x 5.5" thick | | | | 582 | 1318 | 1978 | 13499 | 3.84 | Panel cracking and rupture |
| 2 | | | | | | | | | | | |
| 3 | | | | | | | | | | | |
| 4 | | | | | | | | | | | |
| 5 | | | | | | | | | | | |
| AVERAGE | | | | | | 582 | 1318 | 1978 | 13499 | 3.84 | |

SGI TESTING SERVICES, LLC

| | |
|---|---|
| DATE REPORTED: | 4/7/2024 |
| FIGURE NO. | B-1 |
| PROJECT NO. | SGI24020 |
| DOCUMENT NO. | |
| FILE NO. | |

FIG. 11

MECHANICALLY STABILIZED EARTH (MSE) RETAINING WALL USING GEOSYNTHETIC REINFORCEMENT BELT WITH CURVILINEAR EMBED APPARATUS IN WALL PANEL

CLAIM OF PRIORITY

The present application is a continuation-in-part (CIP) of application Ser. No. 29/890,697, filed Apr. 26, 2023, which is incorporated herein by reference in its entirety.

FIELD OF THE INVENTION

The present invention generally relates to modular earth retaining walls, and more particularly, to mechanically stabilized earth (MSE) retaining walls that use geosynthetic reinforcement belts.

BACKGROUND OF THE INVENTION

Modular earth retaining walls with concrete panels are commonly used for architectural and site development applications. Such walls are subjected to very high pressures exerted by lateral movements of the soil, temperature, and shrinkage effects, and seismic loads.

In many commercial applications, for example, along or supporting highways, etc., each concrete panel can weigh between two and five thousand pounds and have a front elevational size of about eight feet in width by about five feet four inches in height.

Oftentimes, the earth retaining walls of this type are reinforced. More specifically, a conventional MSE retaining wall with steel reinforcement is typically reinforced with steel strips or welded wire meshes that extends backward, or perpendicular, from the rear of a concrete panel to reinforce the backfill soil.

However, steel reinforcement is not preferred or allowed when using high resistivity backfill soils or high corrosion environments that exist on project sites, like near the saltwater coast or roadways that have de-icing salt spread during winter. Geosynthetic reinforcement using flexible geosynthetic reinforcement belts, sometimes referred to as strips or straps, is preferred and used to create the MSE retaining wall. The reinforcement belts are oftentimes made from a polymer material. In the market today, there exist several ways of connecting flexible geosynthetic reinforcement belts to the back side of an MSE concrete panel.

Some of the significant challenges in this field of design are the cost and design complexity that oftentimes requires specially made parts that are not readily available and/or expensive. That is the focus of the present disclosure.

SUMMARY OF THE INVENTION

The present disclosure provides various embodiments for producing an inexpensive and effective mechanically stabilized earth (MSE) retaining wall that employs geosynthetic reinforcement belts.

One embodiment, among others, is a curvilinear embed apparatus for enabling connection of a geosynthetic reinforcement belt to a concrete wall panel of a mechanically stabilized earth (MSE) retaining wall. The curvilinear embed apparatus has walls defining a rectangular channel that extends from a first rectangular aperture through a curved body to a second rectangular aperture. The curvilinear embed apparatus can be made from an inexpensive plastic or other material. The reinforcement belt is passed through the rectangular channel. The curved body implements the required anchoring effect while also enabling easy insertion and passage of the geosynthetic reinforcement belt through the curvilinear embed apparatus. The curved body is also designed to cause the rectangular cross section as well as any anchored reinforcement belt to be rotated by 180 degrees from the first aperture to the second aperture.

Another embodiment, among others, is a curvilinear embed apparatus for enabling connection of a geosynthetic loop to a concrete wall panel of an MSE retaining wall. The curvilinear embed apparatus has a plurality of walls defining a channel that extends from a first aperture through a curved body to a second aperture. The curvature of the curved body enables the required anchoring effect while also enabling easy insertion and passage of the geosynthetic reinforcement belt through the curvilinear embed apparatus by a worker on site.

In this embodiment, the plurality of walls includes a long side outer wall, a long side inner wall that opposes the long side outer wall, a short side inner wall, and a short side outer wall that opposes the short side inner wall. The first and second apertures are arranged adjacent to each other and spaced apart. Each of the apertures has a long side outer edge at the long side outer wall, a long side inner edge at the long side inner wall, a short side inner edge at the short side inner wall, and a short side outer edge at the short side outer wall. The long side outer edge of the first aperture is in linear alignment with the long side inner edge of the second aperture, and the long side inner edge of the first aperture is in linear alignment with the long side outer edge of the second aperture.

Yest another embodiment, among others, is a concrete panel for an MSE retaining wall. The concrete panel has a plurality of exterior walls including front, back, and side walls. The walls enclose an interior of concrete. A curvilinear embed apparatus is embedded in the interior concrete. The curvilinear embed apparatus has a plurality of walls defining an open channel that extends from a first aperture through a curved body to a second aperture. The first and second apertures are situated on the back wall of the panel. The channel and the first and second apertures have a continuous uniform rectangular cross section. The curved body is designed to cause the rectangular cross section (as well as any reinforcement belt passed through it) to transition or rotate by 180 degrees from the first aperture to the second aperture.

Other embodiments, apparatus, systems, methods, features, and advantages of the present disclosure will be or become apparent to one with skill in the art upon examination of the following drawings and detailed description. It is intended that all such additional embodiments, apparatus, systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

FIG. 11 shows a summary of connection strength test results, indicating the sufficient connection effectiveness of the curvilinear embed apparatus of FIGS. 1 through 8.

DETAILED DESCRIPTION OF THE PREFERRED EMBODIMENT(S)

FIGS. 1 through 8 show various views of the preferred embodiment of the curvilinear embed apparatus 10 of the present disclosure from various respective vantage points. The curvilinear embed apparatus 10 enables connection of a geosynthetic loop to a concrete wall panel 12 (FIG. 9) of a mechanically stabilized earth (MSE) retaining wall 14 (FIG. 9).

Figure 2:
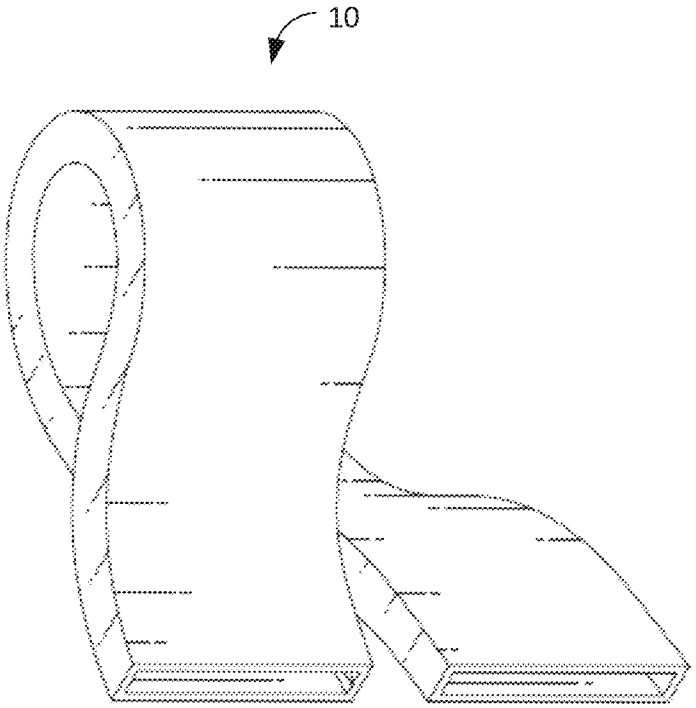
FIGS. 1 through 8 show various views of the curvilinear embed apparatus of the present disclosure from various respective vantage points.
Figure 1:
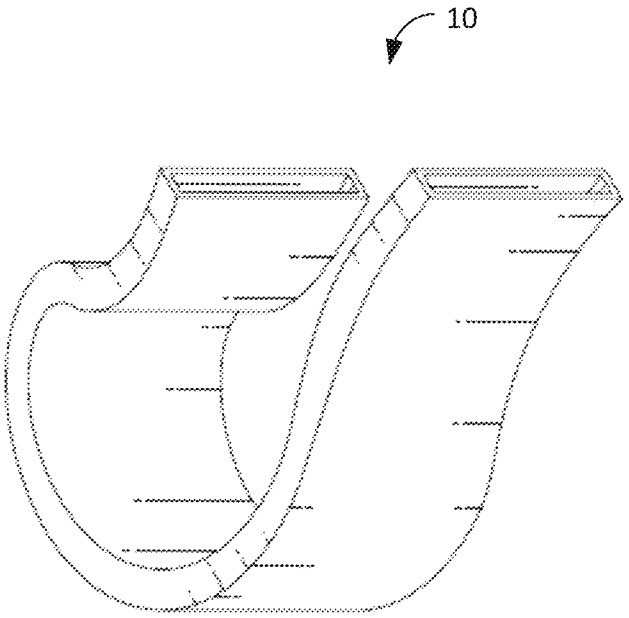
Figure 4:
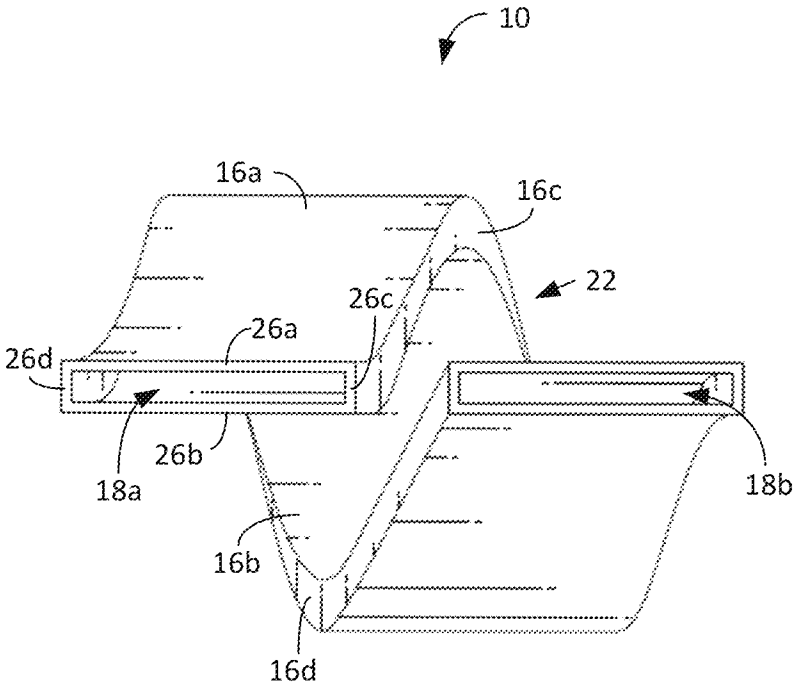
Figure 3:
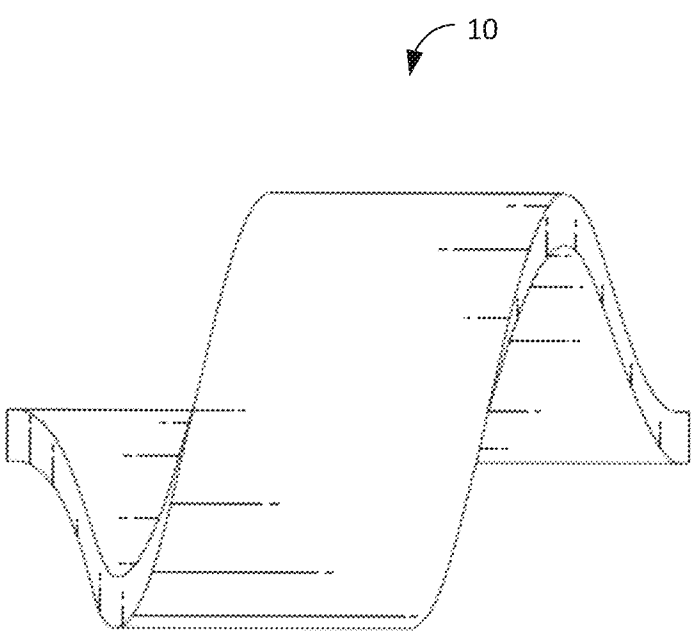
Figure 5:
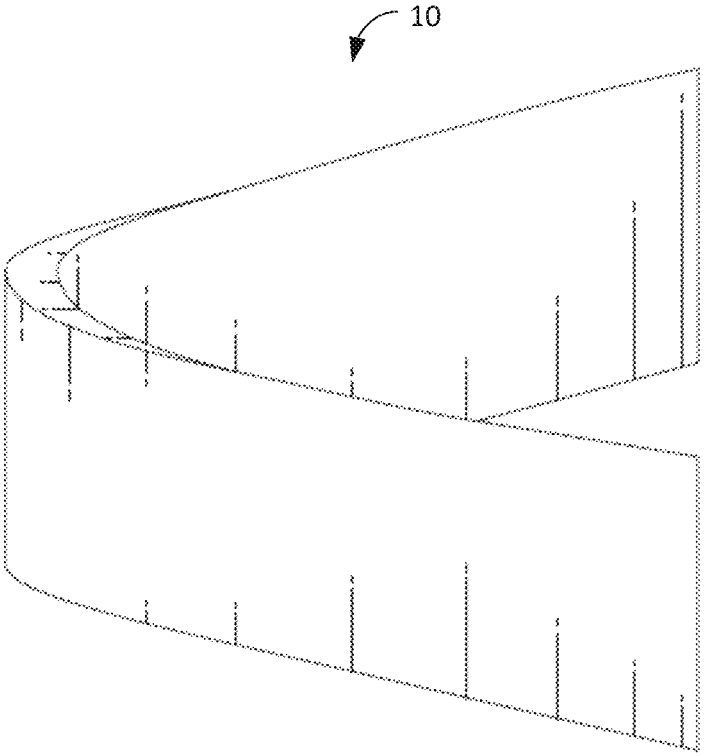
Figure 6:
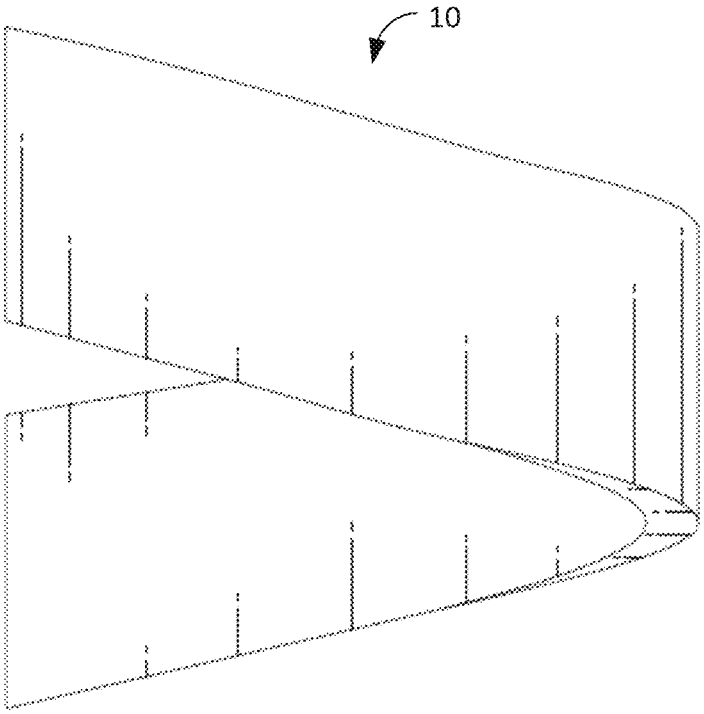
Figure 7:
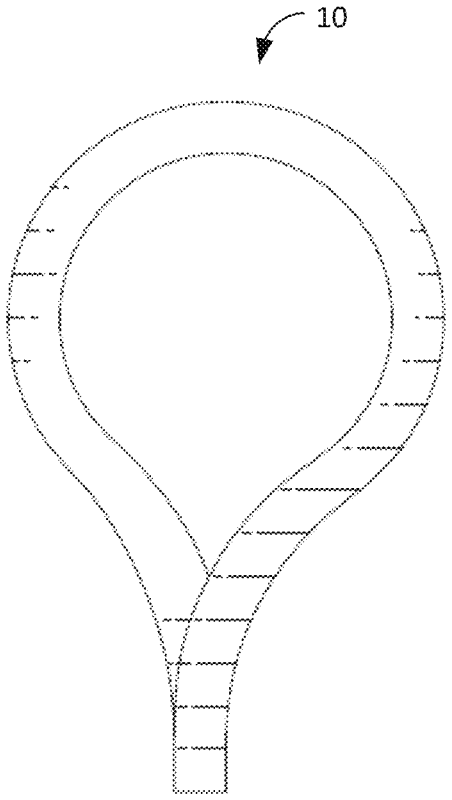
Figure 8:
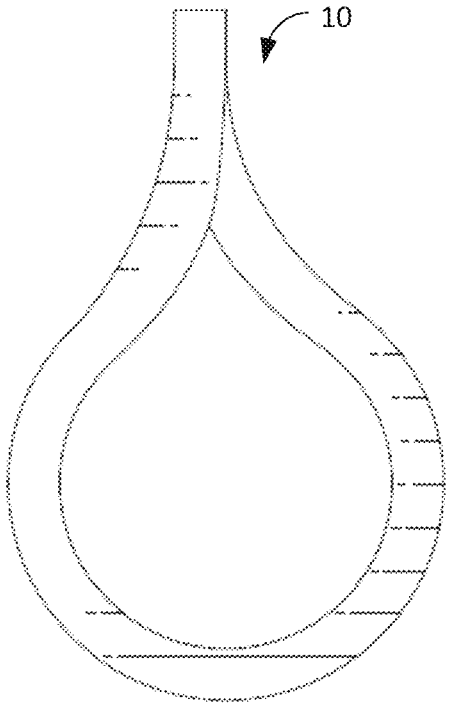

FIG. 4 shows the positional posture of the curvilinear embed apparatus 10 when embedded in a concrete panel 12 and when the concrete panel 12 is installed on site in an MSE retaining wall 14, from the vantage point viewed from the back side of the panel 12 and wall 14. Referring to FIG. 4, the curvilinear embed apparatus 10 includes a plurality of walls 16 defining a rectangular, tube-like, open channel that extends from an open first aperture 18*a* through a curved body 22 to an open second aperture 18*b*. The curved body 22 is a curvilinear structure. The channel and the apertures 18, 18*b* are preferably, although not necessarily, rectangular in cross sectional shape. The channel has an adequate shape and size to receive a flexible geosynthetic reinforcement belt 24 (FIG. 9) associated with the loop. The flexible geosynthetic reinforcement belt 24 has an elongated body extending through the channel of the curvilinear embed apparatus 10 to create the loop between first and second ends that are situated within backfill soil. The reinforcement belt 24 is typically, for example, about 2 inches, in width. The plurality of walls 16 including a long side outer wall 16*a*, a long side inner wall 16*b* that opposes and is parallel to the long side outer wall 16*a*, a short side inner wall 16*c*, and a short side outer wall 16*d* that opposes and is parallel to the short side inner wall 16*c*.

The first and second apertures 18*a*, 18*b* are arranged adjacent to each other in a side-by-side manner (or arrangement), spaced apart, so that a geosynthetic reinforcement belt 24 (FIG. 9) can enter one of the apertures 18*a*, 18*b* and exit the other of the apertures 18*a*, 18*b* in the same plane. The curvature of the curved body 22 of the curvilinear embed apparatus 10, which is preferably continuously curved, makes it easy to insert an end of the reinforcement belt 24 into one of the apertures 18*a*, 18*b* and thread it through the curvilinear embed apparatus 10.

Each of the apertures 18*a*, 18*b* has a long side outer edge 26*a* at the long side outer wall 16*a*, a long side inner edge 26*b* at the long side inner wall 16*b*, a short side inner edge 26*c* at the short side inner wall 16*cl*, and a short side outer edge 26*d* at the short side outer wall 16*d*. The long side outer edge 26*a* of the first aperture 18*a* is in horizontal linear alignment with the long side inner edge 26*b* of the second aperture 18*b*, and the long side inner edge 26*b* of the first aperture 18*a* is in horizontal linear alignment with the long side outer edge 26*a* of the second aperture 18*b*.

The curvilinear embed apparatus 10 can be manufactured from any suitable material, for example, but not limited to, plastic, rubber, etc., but preferably an inexpensive plastic material.

Figure 9A:
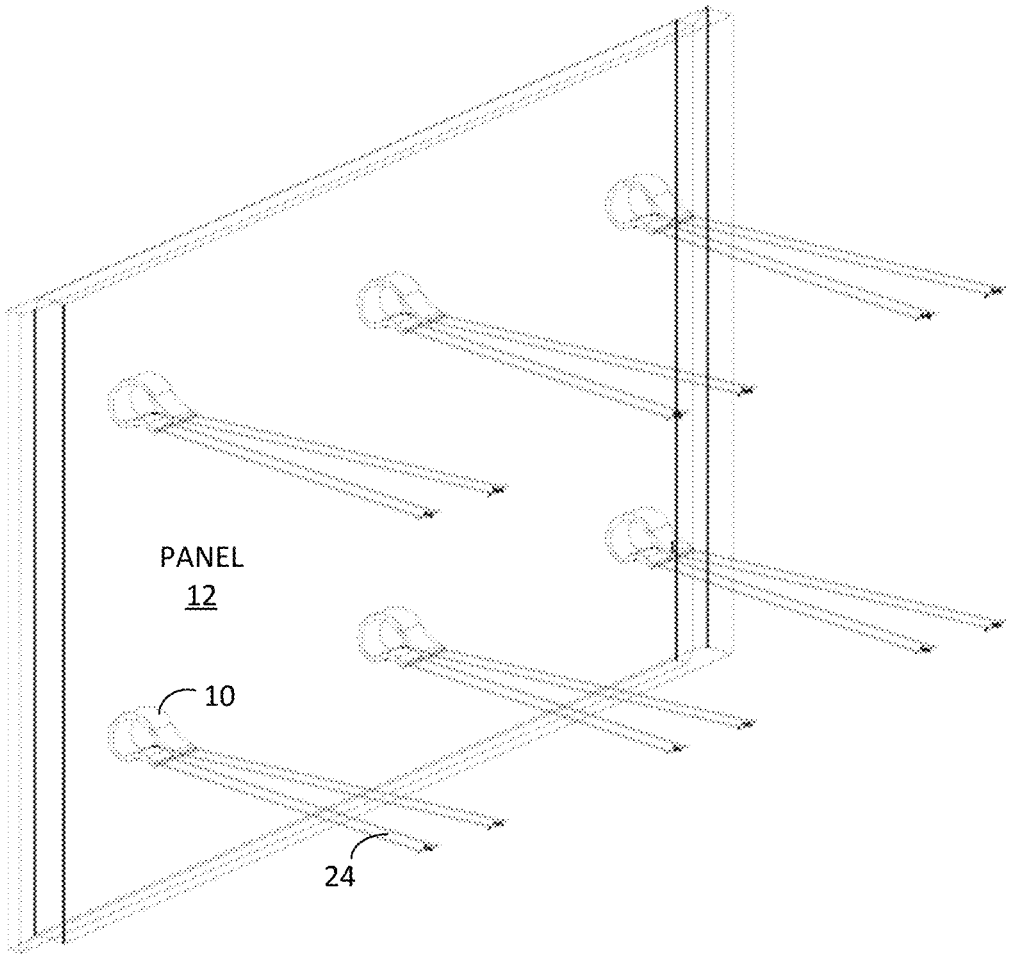
FIGS. 9A and 9B show the curvilinear embed apparatus of FIGS. 1 through 8 embedded in a concrete panel of a mechanically stabilized earth (MSE) retaining wall with geosynthetic reinforcement belt in phantom lines extending through the panel.
Figure 9B:
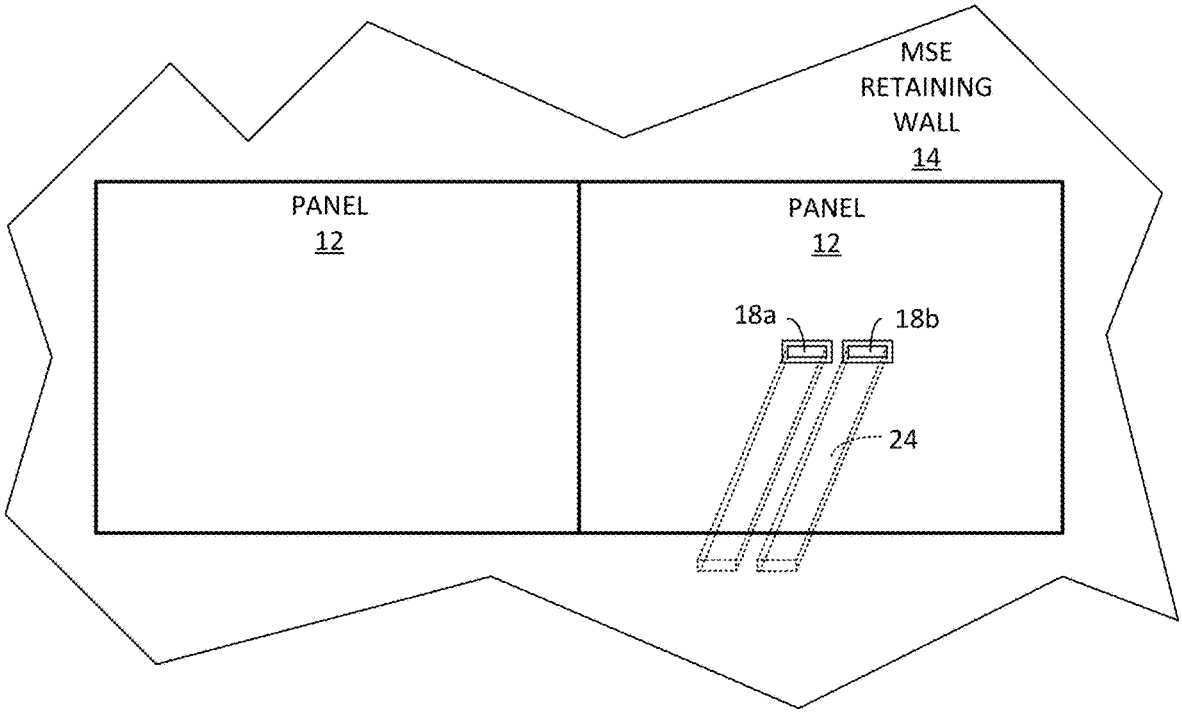

FIGS. 9A and 9B show the curvilinear embed apparatus 10 embedded in a concrete panel 12 of an MSE retaining wall 14 with geosynthetic reinforcement belt 24 in phantom lines extending through and anchoring the panel 12. The concrete panel 12 has a plurality of exterior walls including front, back, and side walls. The walls enclose an interior of concrete, where the curvilinear embed apparatus 10 is embedded during the manufacturing process. The first and second apertures 18*a*, 18*b* are situated on the back wall of the panel 12. In the preferred embodiment, the channel and the first and second apertures 18*a*, 18*b* have a continuous uniform rectangular cross section. The curved body is generally about one cycle of a helix with non-helical aperture extensions at its ends, which change the direction of the helix to provide the apertures 18*a*, 18*b*, in spaced apart, side-by-side alignment in the same plane. The curved body of the channel is designed to cause the rectangular cross section (as well as the reinforcement belt 24) to be rotated by 180 degrees from the first aperture 18*a* to the second aperture 18*b*. The reinforcement belt 24 enters the first aperture 18*a* with the top side up and the bottom side down and exits from the second aperture 18*b* in the same plane with the bottom side up and the top side down.

Figure 10:
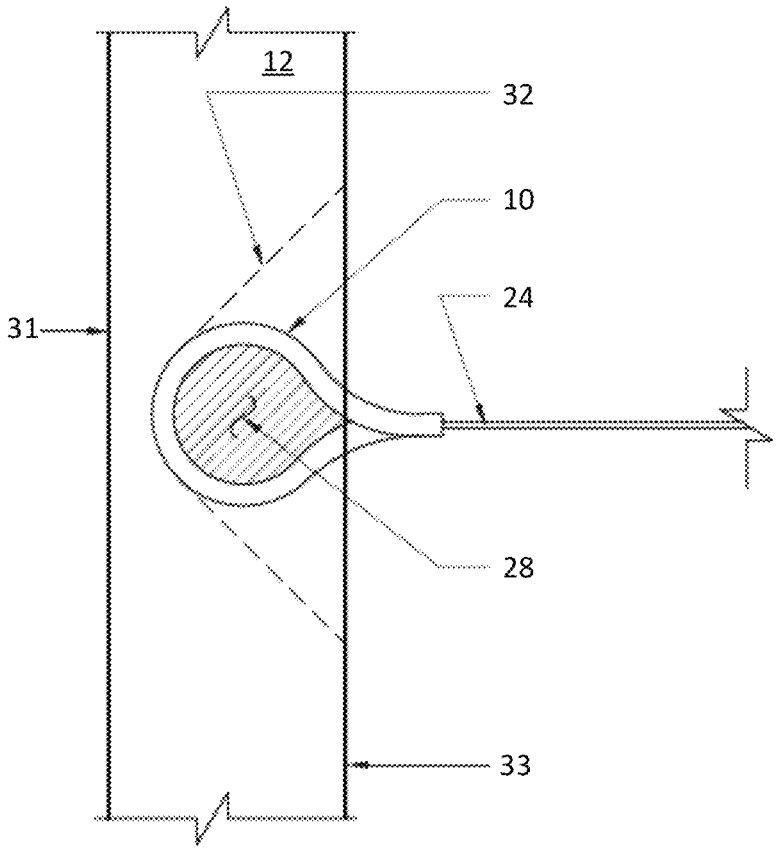
FIG. 10 shows a cross section of the concrete panel of FIG. 9.

FIG. 10 shows a cross section of the concrete panel 12 having a front face 31 and a back face 33. The geosynthetic reinforcement belt 24 within the concrete panel itself creates an anchoring effect, as shown in FIG. 10. Knowing the anchor must be at least 4 inches by two inches or approximately 8 square inches of anchor surface area to create the required resisting concrete breakout force, the reinforcement belt needs to create this anchored area. Reference numeral 32 shows the effective cone of concrete breakout. With the geosynthetic reinforcement belt 24 making a loop around a portion of the concrete panel 12 with the geosynthetic reinforcement belt 24 entering and exiting at the same elevation, the inside of the loop creates an equivalent anchor embed 28 by again encircling or encapsulation a portion of the concrete panel 12 within the looped reinforcement belt, which together creates an effective anchor within the concrete panel 12.

As illustrated in FIG. 11, the result from full scale connection tests to failure has found the looped reinforcement of the present disclosure provides a sufficient breakout resistance. More specifically, FIG. 11 shows a summary of connection strength test results, indicating the sufficient connection effectiveness of the curvilinear embed apparatus 10 of FIGS. 1 through 8. The testing definitively shows sufficient pullout of 13,499 pounds (lbs). Based upon engineering assessment, the minimum that is required is 12,260 lbs. These results were surprising and unexpected by the inventor.

Finally, it should be emphasized that the above-described embodiment(s), particularly any preferred embodiment(s), of the present disclosure is merely a possible nonlimiting example of an implementation, merely set forth for a clear understanding of the principles of the invention. Many variations and modifications may be made to the above-described embodiment(s) of the invention without departing substantially from the spirit and principles of the invention.

All such modifications and variations are intended to be included herein within the scope of this disclosure and the present invention.

The invention claimed is:

1. A curvilinear embed apparatus for enabling connection of a geosynthetic loop to a concrete wall panel of a mechanically stabilized earth (MSE) retaining wall, the curvilinear embed apparatus comprising:

a plurality of walls defining a rectangular channel that extends from a first rectangular aperture through a curved body to a second rectangular aperture, the plurality of walls including a long side outer wall, a long side inner wall that is parallel to the long side outer wall, a short side inner wall, and a short side outer wall that is parallel to the short side inner wall;

wherein the first and second rectangular apertures are arranged in a side-by-side manner, each of the apertures having a long side outer edge at the long side outer wall, a long side inner edge at the long side inner wall, a short side inner edge at the short side inner wall, and a short side outer edge at the short side outer wall;

wherein the long side outer edge of the first rectangular aperture is in linear alignment with the long side inner edge of the second rectangular aperture;

wherein the long side inner edge of the first rectangular aperture is in linear alignment with the long side outer edge of the second rectangular aperture; and wherein the curved body is about one cycle of a helix with non-linear aperture extensions at first and second ends of the curved body, the first and second ends having respectively the first and second rectangular apertures.

2. The apparatus of claim 1, wherein the curvilinear embed apparatus is comprised of a plastic material.

3. The apparatus of claim 1, wherein the curvilinear embed apparatus is comprised of a rubber material.

4. The apparatus of claim 1, wherein the channel has an adequate size to receive a geosynthetic reinforcement belt associated with the loop.

5. The apparatus of claim 1, further comprising a geosynthetic reinforcement belt having an elongated body extending between first and second ends with a top side and a bottom side, the body extending through the channel of the curvilinear embed apparatus to create the loop between the first and second ends, the first and second ends being situated within backfill soil and wherein the reinforcement belt enters the first rectangular aperture with the top side up and the bottom side down and exits the second rectangular aperture with the bottom side up and the top side down.

6. The apparatus of claim 1, further comprising a concrete embed defined by and encircled by the long side inner wall of the curved body.

7. A wall panel for an earth retaining wall, the wall panel comprising: a concrete panel including the apparatus of claim 1 embedded therein.

8. An MSE retaining wall, wherein the wall comprises the wall panel of claim 7.

9. A curvilinear embed apparatus for enabling connection of a geosynthetic loop to a concrete wall panel of a mechanically stabilized earth (MSE) retaining wall, the curvilinear embed apparatus comprising:

a plurality of walls defining a channel that extends from a first aperture through a curved body to a second aperture, the plurality of walls including a long side outer wall, a long side inner wall that opposes the long side outer wall, a short side inner wall, and a short side outer wall that opposes the short side inner wall;

wherein the first and second apertures are arranged adjacent to each other and spaced apart, each of the apertures having a long side outer edge at the long side outer wall, a long side inner edge at the long side inner wall, a short side inner edge at the short side inner wall, and a short side outer edge at the short side outer wall;

wherein the long side outer edge of the first aperture is in linear alignment with the long side inner edge of the second aperture; wherein the long side inner edge of the first aperture is in linear alignment with the long side outer edge of the second aperture; and wherein the curved body is about one cycle of a helix with non-linear aperture extensions at first and second ends of the curved body, the first and second ends having respectively the first and second apertures.

10. The apparatus of claim 9, wherein the channel and the first and second apertures each have a rectangular cross section.

11. The apparatus of claim 9, wherein the curvilinear embed apparatus is comprised of a plastic material.

12. The apparatus of claim 9, wherein the curvilinear embed apparatus is comprised of a rubber material.

13. The apparatus of claim 9, wherein the channel has an adequate size to receive a geosynthetic reinforcement belt associated with the loop.

14. The apparatus of claim 9, further comprising a geosynthetic reinforcement belt having an elongated body extending between first and second ends with a top side and a bottom side, the body extending through the channel of the curvilinear embed apparatus to create the loop between the first and second ends, the first and second ends being situated within backfill soil and wherein the reinforcement belt enters the first aperture with the top side up and the bottom side down and exits the second aperture with the bottom side up and the top side down.

15. The apparatus of claim 9, further comprising a concrete embed defined by and encircled by the long side inner wall of the curved body.

16. A wall panel for an earth retaining wall, the wall panel comprising: a concrete panel including the apparatus of claim 9 embedded therein.

17. An MSE retaining wall, wherein the wall comprises the wall panel of claim 16.

18. A concrete panel for a mechanically stabilized earth (MSE) retaining wall, the concrete panel comprising:

a plurality of exterior walls including front, back, and side walls, the walls enclosing an interior of concrete; a curvilinear embed apparatus embedded in the interior concrete, the curvilinear embed apparatus having a plurality of walls defining an open channel that extends from a first aperture through a curved body to a second aperture, the first and second apertures being situated on the back wall, the channel and the first and second apertures having a uniform rectangular cross section, the curved body designed to cause the rectangular cross section to transition by 180 degrees from the first aperture to the second aperture;

wherein the curved body is helical in shape with non-linear aperture extensions at first and second ends of the curved body, the first and second ends having respectively the first and second apertures; and wherein the curved body is about one cycle of a helix.

19. The concrete pane of claim 18, wherein the curvilinear embed apparatus is comprised of a plastic material.

20. The concrete pane of claim 18, where the curvilinear embed apparatus is comprised of a rubber material.

21. An earth retaining wall, wherein the wall comprises the concrete panel of claim 18.

22. A curvilinear embed apparatus for enabling connection of a geosynthetic loop to a concrete wall panel of an earth retaining wall, the curvilinear embed apparatus comprising:

a plurality of walls defining a channel that extends in a continuous manner from a first aperture through a curved body to a second aperture, the channel and the first and second apertures each having a particular rectangular cross section that exhibits a suitable size to receive a geosynthetic reinforcement belt in order to create the geosynthetic loop, the curved body designed to cause the rectangular cross section to be rotated by 180 degrees as the channel progresses between the first and second apertures and provide the first and second apertures in a side-by-side arrangement;

wherein the curved body is helical in shape with non-linear aperture extensions at first and second ends of the curved body, the first and second ends having respectively the first and second apertures; and wherein the curved body is about one cycle of a helix.

23. A curvilinear embed apparatus for enabling connection of a geosynthetic loop to a concrete wall panel of an earth retaining wall, the curvilinear embed apparatus comprising:

a plurality of walls defining a channel that extends in a continuous manner from a first aperture through a curved body to a second aperture, the channel and the first and second apertures each having a particular rectangular cross section that exhibits a suitable size to receive a geosynthetic reinforcement belt in order to create the geosynthetic loop, the curved body designed to cause the rectangular cross section to be rotated by 180 degrees as the channel progresses between the first and second apertures and provide the first and second apertures in a side-by-side arrangement;

wherein the curved body is helical in shape with non-linear aperture extensions at first and second ends of the curved body, the first and second ends having respectively the first and second apertures; and a geosynthetic reinforcement belt having an elongated body extending between first and second ends with a top side and a bottom side, the body extending through the channel of the curvilinear embed apparatus to create the loop between the first and second ends, the first and second ends being situated within backfill soil and wherein the reinforcement belt enters the first rectangular aperture with the top side up and the bottom side down and exits the second rectangular aperture with the bottom side up and the top side down.

* * * * *